US012800221B2

(12) United States Patent
Coscia et al.

(10) Patent No.: US 12,800,221 B2
(45) Date of Patent: Nov. 17, 2026

(54) NATURAL GAS LIQUEFACTION PROCESS AND PLANT TO CARRY IT OUT

(71) Applicant: Universidad Nacional de Itapúa, Itapua (PY)

(72) Inventors: Eugenio Jose Cano Coscia, Distrito de Cambyreta (PY); Jorge Alberto Mellid Samusik, Ciudad de Encarnación (PY); Fernando Luis Galeano Flores, Ciudad de Hohenau (PY)

(73) Assignee: Universidad Nacional de Itapúa, Itapua (PY)

( * ) Notice: Subject to any disclaimer, the term of this patent is extended or adjusted under 35 U.S.C. 154(b) by 255 days.

(21) Appl. No.: 18/731,905

(22) Filed: Jun. 3, 2024

(65) Prior Publication Data

US 2025/0075973 A1 Mar. 6, 2025

(51) Int. Cl.
*F25J 1/00* (2006.01)

(52) U.S. Cl.
CPC ..... *F25J 1/0022* (2013.01)

(58) Field of Classification Search
CPC ..... F25J 1/0022; F25J 1/004; F25J 1/0052; F25J 1/0055; F25J 1/0087; F25J 1/0258; F25J 1/0261; F25J 1/0262; F25J 1/0265; F25J 1/0297; F25J 2220/64; F25J 2230/04; F25J 2245/90; F25J 2270/12; F25J 2270/90; F25J 2290/62
See application file for complete search history.

(56) References Cited

U.S. PATENT DOCUMENTS

| | | | | |
|---|---|---|---|---|
| 2,856,756 | A | 10/1958 | Köhler | |
| 3,763,658 | A | 10/1973 | Gaumer, Jr. et al. | |
| 3,914,949 | A | 10/1975 | Maher et al. | |
| 3,932,154 | A | 1/1976 | Coers et al. | |
| 5,611,216 | A | 3/1997 | Low | |
| 5,644,502 | A | 7/1997 | Little | |
| 6,253,574 | B1 | 7/2001 | Stockmann et al. | |
| 6,751,984 | B2 | 6/2004 | Neeraas et al. | |
| 8,806,891 | B2 | 8/2014 | Brendeng | |
| 10,465,982 | B2 * | 11/2019 | Tang | F25J 1/0265 |
| 11,561,042 | B2 * | 1/2023 | Felbab | F25J 1/0291 |
| 11,561,043 | B2 * | 1/2023 | Butts | F25J 3/0238 |
| 11,604,025 | B2 * | 3/2023 | Chan | F25J 3/0209 |
| 11,774,173 | B2 * | 10/2023 | Minigulov | F25J 1/0085 62/612 |
| 2007/0193303 | A1 * | 8/2007 | Hawrysz | F25J 1/0294 62/620 |
| 2008/0141711 | A1 | 6/2008 | Roberts | |
| 2008/0156037 | A1 * | 7/2008 | Van De Graaf | F25J 1/0238 62/612 |
| 2014/0318178 | A1 | 10/2014 | Del Campo | |
| 2015/0211788 | A1 | 7/2015 | Holtzapple | |
| 2019/0323769 | A1 * | 10/2019 | Ducote, Jr. | F25J 1/0022 |

(Continued)

FOREIGN PATENT DOCUMENTS

| | | |
|---|---|---|
| GB | 719879 | 12/1954 |
| WO | WO2007067093 | 6/2007 |

*Primary Examiner* — Filip Zec
(74) *Attorney, Agent, or Firm* — Defillo & Associates, Inc.; Evelyn A. Defillo

(57) ABSTRACT

Gas liquefaction process, preferably natural gas in a small-scale plant that includes compression cycles, refrigeration with various refrigerants and expansion, and a small-scale plant that includes of 4 loops to carry it out.

23 Claims, 10 Drawing Sheets

(56) References Cited

U.S. PATENT DOCUMENTS

| | | | | |
|---|---|---|---|---|
| 2019/0360747 | A1* | 11/2019 | Nikiforuk | F25J 1/0012 |
| 2022/0016565 | A1* | 1/2022 | Krishnamurthy | B01D 53/0431 |
| 2022/0178609 | A1* | 6/2022 | Horne | F25J 3/0615 |
| 2023/0027070 | A1* | 1/2023 | Malik | F25J 3/04157 |
| 2023/0408188 | A1* | 12/2023 | Prosser | F25J 1/0202 |

* cited by examiner

Figure 5

Material Streams

* Specified by user.

| Name | | 2 | 3 | 4 | 10 | 5 |
|---|---|---|---|---|---|---|
| Vapour Fraction | | 1.0000 | 1.0000 | 1.0000 | 0.9191 | 0.9764 |
| Temperature | (C) | 74.15 | 11.00 * | 64.24 | -3.000 * | 11.00 * |
| Pressure | (psia) | 141.0 * | 141.0 | 300.0 * | 298.0 | 300.0 |
| Molar Flow | (kgmole/h) | 9.562 | 9.562 | 9.562 | 9.337 | 9.562 |
| Mass Flow | (kg/h) | 261.0 | 261.0 | 261.0 | 249.7 | 261.0 |
| Liquid Volume Flow | (m3/h) | 0.6164 | 0.6164 | 0.6164 | 0.5951 | 0.6164 |
| Heat Flow | (kW) | -98.58 | -107.0 | -100.9 | -106.6 | -109.2 |

| Name | | 11 | 12 | 6 | 8 | 9 |
|---|---|---|---|---|---|---|
| Vapour Fraction | | 0.8521 | 0.0331 | 0.0000 | 0.6040 | 0.9902 |
| Temperature | (C) | -18.00 * | -125.0 * | 11.00 | 9.000 * | 9.548 |
| Pressure | (psia) | 296.0 | 294.0 | 300.0 | 50.00 | 300.0 |
| Molar Flow | (kgmole/h) | 9.337 | 9.337 | 0.2256 | 0.2256 | 9.337 |
| Mass Flow | (kg/h) | 249.7 | 249.7 | 11.33 | 11.33 | 249.7 |
| Liquid Volume Flow | (m3/h) | 0.5951 | 0.5951 | 2.135e-002 | 2.135e-002 | 0.5951 |
| Heat Flow | (kW) | -111.0 | -142.2 | -7.530 | -6.964 | -102.2 |

| Name | | 7 | 13 | 27 | 29 | 28 |
|---|---|---|---|---|---|---|
| Vapour Fraction | | 0.2414 | 0.2220 | 0.0000 | 0.0000 | 0.0000 |
| Temperature | (C) | -12.66 | 142.6 | 7.425 | 11.34 | 7.425 |
| Pressure | (psia) | 50.00 | 58.00 | 34.70 | 14.70 | 34.70 |
| Molar Flow | (kgmole/h) | 0.2256 | 9.337 | 99.92 | 99.92 | 122.1 |
| Mass Flow | (kg/h) | 11.33 | 249.7 | 1800 | 1800 | 2200 |
| Liquid Volume Flow | (m3/h) | 2.135e-002 | 0.5951 | 1.804 | 1.804 | 2.204 |
| Heat Flow | (kW) | -7.530 | -142.2 | -7982 | -7973 | -9755 |

| Name | | 30 | 51 | 16 | 15 | 20 |
|---|---|---|---|---|---|---|
| Vapour Fraction | | 0.0000 | 1.0000 | 1.0000 | 1.0000 | 0.5131 |
| Temperature | (C) | 10.61 | 11.00 | 8.350 | -29.45 | -18.77 |
| Pressure | (psia) | 14.70 | 300.0 | 50.00 | 53.00 | 37.00 |
| Molar Flow | (kgmole/h) | 122.1 | 9.337 | 9.337 | 9.337 | 1.631 |
| Mass Flow | (kg/h) | 2200 | 249.7 | 249.7 | 249.7 | 71.92 |
| Liquid Volume Flow | (m3/h) | 2.204 | 0.5951 | 0.5951 | 0.5951 | 0.1419 |
| Heat Flow | (kW) | -9747 | -101.7 | -100.1 | -104.5 | -52.53 |

| Name | | 21 | 35 | 36 | 41 | 42 |
|---|---|---|---|---|---|---|
| Vapour Fraction | | 1.0000 | 1.0000 | 0.9992 | 1.0000 | 1.0000 |
| Temperature | (C) | -3.608 | -10.00 | -18.83 | -144.9 | -12.00 * |
| Pressure | (psia) | 35.00 | 150.0 | 149.0 | 43.00 | 41.00 |
| Molar Flow | (kgmole/h) | 1.631 | 1.985 | 1.985 | 0.1554 | 0.1554 |
| Mass Flow | (kg/h) | 71.92 | 33.86 | 33.86 | 2.879 | 2.879 |
| Liquid Volume Flow | (m3/h) | 0.1419 | 0.1072 | 0.1072 | 7.718e-003 | 7.718e-003 |
| Heat Flow | (kW) | -48.15 | -41.24 | -41.43 | -2.809 | -2.618 |

| Name | | 37 | 38 | 40 | 39 | GNL |
|---|---|---|---|---|---|---|
| Vapour Fraction | | 0.0000 | 0.0000 | 1.0000 | 0.0783 | 0.0000 |
| Temperature | (C) | -140.0 * | -140.2 * | -149.2 | -149.2 | -149.2 |
| Pressure | (psia) | 147.0 | 146.0 | 45.00 | 45.00 * | 45.00 |
| Molar Flow | (kgmole/h) | 1.985 | 1.985 | 0.1554 | 1.985 | 1.830 |
| Mass Flow | (kg/h) | 33.86 | 33.86 | 2.879 | 33.86 | 30.98 |
| Liquid Volume Flow | (m3/h) | 0.1072 | 0.1072 | 7.718e-003 | 0.1072 | 9.944e-002 |
| Heat Flow | (kW) | -47.92 | -47.93 | -2.816 | -47.93 | -45.11 |

| Name | | 14 | 22 | 23 | 24 | 25 |
|---|---|---|---|---|---|---|
| Vapour Fraction | | 0.4437 | 1.0000 | 1.0000 | 0.0000 * | 0.3239 |
| Temperature | (C) | -126.8 | 10.00 * | 92.32 | 55.00 * | 6.821 |
| Pressure | (psia) | 56.00 | 90.00 * | 316.7 | 316.7 | 90.00 |
| Molar Flow | (kgmole/h) | 9.337 | 5.104 | 5.104 | 5.104 | 5.104 |
| Mass Flow | (kg/h) | 249.7 | 441.3 * | 441.3 | 441.3 | 441.3 |
| Liquid Volume Flow | (m3/h) | 0.5951 | 0.3594 | 0.3594 | 0.3594 | 0.3594 |
| Heat Flow | (kW) | -135.7 | -713.8 | -708.6 | -730.7 | -730.7 |

Figure 5 (Continuation)

Material Streams (continued)

* Specified by user.

| Name | | 50 | 51 | 49 | 31 | 26 |
|---|---|---|---|---|---|---|
| Vapour Fraction | | 0.0000 | 0.0000 | 0.0000 | 0.0000 | 0.0000 |
| Temperature | (C) | 11.01 | 7.489 | 11.00 * | 10.94 | 7.425 |
| Pressure | (psia) | 34.70 | 34.70 | 14.70 * | 14.70 * | 34.70 |
| Molar Flow | (kgmole/h) | 222.0 | 222.0 | 222.0 | 222.0 | 222.0 |
| Mass Flow | (kg/h) | 4000 | 4000 | 4000 * | 4000 | 4000 |
| Liquid Volume Flow | (m3/h) | 4.008 | 4.008 | 4.008 | 4.008 | 4.008 |
| Heat Flow | (kW) | -1.772e+004 | -1.774e+004 | -1.772e+004 | -1.772e+004 | -1.774e+004 |
| Name | | 17 | 52 | 47 | 18 | 19 |
| Vapour Fraction | | 1.0000 | 1.0000 | 1.0000 | 1.0000 | 0.0000 * |
| Temperature | (C) | 7.000 * | -1.147 | 14.96 | 105.3 | 55.00 * |
| Pressure | (psia) | 35.00 * | 35.00 | 35.00 | 280.0 | 278.0 |
| Molar Flow | (kgmole/h) | 1.875 | 1.875 | 0.2437 | 1.875 | 1.875 |
| Mass Flow | (kg/h) | 82.67 * | 82.67 | 10.75 | 82.67 | 82.67 |
| Liquid Volume Flow | (m3/h) | 0.1632 | 0.1632 | 2.121e-002 | 0.1632 | 0.1632 |
| Heat Flow | (kW) | -54.94 | -55.25 | -7.103 | -51.55 | -60.38 |
| Name | | 32 | 45 | 43 | 44 | 33.1 |
| Vapour Fraction | | 0.0000 | 0.0000 | 1.0000 | 1.0000 | 1.0000 |
| Temperature | (C) | 55.00 | 55.00 | 112.8 | 20.00 * | 27.12 |
| Pressure | (psia) | 278.0 | 278.0 | 150.0 * | 150.0 * | 150.0 |
| Molar Flow | (kgmole/h) | 1.631 | 0.2437 | 0.1554 | 1.819 | 1.974 |
| Mass Flow | (kg/h) | 71.92 | 10.75 | 2.879 | 31.12 | 34.00 * |
| Liquid Volume Flow | (m3/h) | 0.1419 | 2.121e-002 | 7.718e-003 | 9.828e-002 | 0.1060 |
| Heat Flow | (kW) | -52.53 | -7.850 | -2.429 | -37.25 | -39.68 |
| Name | | 34 | 46 | 33 | 48 | 1 |
| Vapour Fraction | | 0.9992 | 0.5200 | 1.0000 | 0.0000 | 1.0000 |
| Temperature | (C) | -10.00 * | -20.33 | 25.58 * | -10.00 | 4.352 |
| Pressure | (psia) | 150.0 | 35.00 | 150.0 * | 150.0 | 50.00 * |
| Molar Flow | (kgmole/h) | 1.987 | 0.2437 | 1.987 | 1.565e-003 | 9.562 |
| Mass Flow | (kg/h) | 34.00 | 10.75 | 34.00 * | 0.1388 | 261.0 * |
| Liquid Volume Flow | (m3/h) | 0.1074 | 2.121e-002 | 0.1074 | 2.087e-004 | 0.6164 |
| Heat Flow | (kW) | -41.33 | -7.850 | -40.59 | -9.130e-002 | -107.1 |

Compositions Fluid Pkg: All

| Name | 2 | 3 | 4 | 10 | 5 |
|---|---|---|---|---|---|
| Comp Mole Frac (Methane) | 0.4400 | 0.4400 | 0.4400 | 0.4490 | 0.4400 |
| Comp Mole Frac (Propane) | 0.0200 | 0.0200 | 0.0200 | 0.0193 | 0.0200 |
| Comp Mole Frac (i-Butane) | 0.1400 | 0.1400 | 0.1400 | 0.1256 | 0.1400 |
| Comp Mole Frac (Ethylene) | 0.2800 | 0.2800 | 0.2800 | 0.2833 | 0.2800 |
| Comp Mole Frac (Ethane) | 0.0000 | 0.0000 | 0.0000 | 0.0000 | 0.0000 |
| Comp Mole Frac (H2O) | 0.0000 | 0.0000 | 0.0000 | 0.0000 | 0.0000 |
| Comp Mole Frac (Nitrogen) | 0.1200 | 0.1200 | 0.1200 | 0.1228 | 0.1200 |
| Comp Mole Frac (Refrig-22) | 0.0000 | 0.0000 | 0.0000 | 0.0000 | 0.0000 |
| Comp Mole Frac (n-Butane) | 0.0000 | 0.0000 | 0.0000 | 0.0000 | 0.0000 |
| Comp Mole Frac (i-Pentane) | 0.0000 | 0.0000 | 0.0000 | 0.0000 | 0.0000 |
| Comp Mole Frac (n-Hexane) | 0.0000 | 0.0000 | 0.0000 | 0.0000 | 0.0000 |
| Comp Mole Frac (n-Pentane) | 0.0000 | 0.0000 | 0.0000 | 0.0000 | 0.0000 |
| Comp Mole Frac (n-Heptane) | 0.0000 | 0.0000 | 0.0000 | 0.0000 | 0.0000 |

Figure 5 (Continuation)

Compositions (continued)

* Specified by user.

| Name | 11 | 12 | 6 | 8 | 9 |
|---|---|---|---|---|---|
| Comp Mole Frac (Methane) | 0.4490 | 0.4490 | 0.0655 | 0.0655 | 0.4490 |
| Comp Mole Frac (Propane) | 0.0193 | 0.0193 | 0.0477 | 0.0477 | 0.0193 |
| Comp Mole Frac (i-Butane) | 0.1256 | 0.1256 | 0.7371 | 0.7371 | 0.1256 |
| Comp Mole Frac (Ethylene) | 0.2833 | 0.2833 | 0.1436 | 0.1436 | 0.2833 |
| Comp Mole Frac (Ethane) | 0.0000 | 0.0000 | 0.0000 | 0.0000 | 0.0000 |
| Comp Mole Frac (H2O) | 0.0000 | 0.0000 | 0.0000 | 0.0000 | 0.0000 |
| Comp Mole Frac (Nitrogen) | 0.1228 | 0.1228 | 0.0061 | 0.0061 | 0.1228 |
| Comp Mole Frac (Refrig-22) | 0.0000 | 0.0000 | 0.0000 | 0.0000 | 0.0000 |
| Comp Mole Frac (n-Butane) | 0.0000 | 0.0000 | 0.0000 | 0.0000 | 0.0000 |
| Comp Mole Frac (i-Pentane) | 0.0000 | 0.0000 | 0.0000 | 0.0000 | 0.0000 |
| Comp Mole Frac (n-Hexane) | 0.0000 | 0.0000 | 0.0000 | 0.0000 | 0.0000 |
| Comp Mole Frac (n-Pentane) | 0.0000 | 0.0000 | 0.0000 | 0.0000 | 0.0000 |
| Comp Mole Frac (n-Heptane) | 0.0000 | 0.0000 | 0.0000 | 0.0000 | 0.0000 |
| Name | 7 | 13 | 27 | 29 | 28 |
| Comp Mole Frac (Methane) | 0.0655 | 0.4490 | 0.0000 | 0.0000 | 0.0000 |
| Comp Mole Frac (Propane) | 0.0477 | 0.0193 | 0.0000 | 0.0000 | 0.0000 |
| Comp Mole Frac (i-Butane) | 0.7371 | 0.1256 | 0.0000 | 0.0000 | 0.0000 |
| Comp Mole Frac (Ethylene) | 0.1436 | 0.2833 | 0.0000 | 0.0000 | 0.0000 |
| Comp Mole Frac (Ethane) | 0.0000 | 0.0000 | 0.0000 | 0.0000 | 0.0000 |
| Comp Mole Frac (H2O) | 0.0000 | 0.0000 | 1.0000 | 1.0000 | 1.0000 |
| Comp Mole Frac (Nitrogen) | 0.0061 | 0.1228 | 0.0000 | 0.0000 | 0.0000 |
| Comp Mole Frac (Refrig-22) | 0.0000 | 0.0000 | 0.0000 | 0.0000 | 0.0000 |
| Comp Mole Frac (n-Butane) | 0.0000 | 0.0000 | 0.0000 | 0.0000 | 0.0000 |
| Comp Mole Frac (i-Pentane) | 0.0000 | 0.0000 | 0.0000 | 0.0000 | 0.0000 |
| Comp Mole Frac (n-Hexane) | 0.0000 | 0.0000 | 0.0000 | 0.0000 | 0.0000 |
| Comp Mole Frac (n-Pentane) | 0.0000 | 0.0000 | 0.0000 | 0.0000 | 0.0000 |
| Comp Mole Frac (n-Heptane) | 0.0000 | 0.0000 | 0.0000 | 0.0000 | 0.0000 |
| Name | 30 | 5.1 | 16 | 15 | 20 |
| Comp Mole Frac (Methane) | 0.0000 | 0.4490 | 0.4490 | 0.4490 | 0.0000 |
| Comp Mole Frac (Propane) | 0.0000 | 0.0193 | 0.0193 | 0.0193 | 1.0000 |
| Comp Mole Frac (i-Butane) | 0.0000 | 0.1256 | 0.1256 | 0.1256 | 0.0000 |
| Comp Mole Frac (Ethylene) | 0.0000 | 0.2833 | 0.2833 | 0.2833 | 0.0000 |
| Comp Mole Frac (Ethane) | 0.0000 | 0.0000 | -0.0000 | -0.0000 | 0.0000 |
| Comp Mole Frac (H2O) | 1.0000 | 0.0000 | -0.0000 | -0.0000 | 0.0000 |
| Comp Mole Frac (Nitrogen) | 0.0000 | 0.1228 | 0.1228 | 0.1228 | 0.0000 |
| Comp Mole Frac (Refrig-22) | 0.0000 | 0.0000 | -0.0000 | -0.0000 | 0.0000 |
| Comp Mole Frac (n-Butane) | 0.0000 | 0.0000 | -0.0000 | -0.0000 | 0.0000 |
| Comp Mole Frac (i-Pentane) | 0.0000 | 0.0000 | -0.0000 | -0.0000 | 0.0000 |
| Comp Mole Frac (n-Hexane) | 0.0000 | 0.0000 | -0.0000 | -0.0000 | 0.0000 |
| Comp Mole Frac (n-Pentane) | 0.0000 | 0.0000 | -0.0000 | -0.0000 | 0.0000 |
| Comp Mole Frac (n-Heptane) | 0.0000 | 0.0000 | -0.0000 | -0.0000 | 0.0000 |
| Name | 21 | 35 | 36 | 41 | 42 |
| Comp Mole Frac (Methane) | 0.0000 | 0.9439 | 0.9439 | 0.7922 | 0.7922 |
| Comp Mole Frac (Propane) | 1.0000 | 0.0033 | 0.0033 | 0.0000 | 0.0000 |
| Comp Mole Frac (i-Butane) | 0.0000 | 0.0013 | 0.0013 | 0.0000 | 0.0000 |
| Comp Mole Frac (Ethylene) | 0.0000 | 0.0000 | 0.0000 | 0.0000 | 0.0000 |
| Comp Mole Frac (Ethane) | 0.0000 | 0.0162 | 0.0162 | 0.0001 | 0.0001 |
| Comp Mole Frac (H2O) | 0.0000 | 0.0000 | 0.0000 | 0.0000 | 0.0000 |
| Comp Mole Frac (Nitrogen) | 0.0000 | 0.0308 | 0.0308 | 0.2077 | 0.2077 |
| Comp Mole Frac (Refrig-22) | 0.0000 | 0.0000 | 0.0000 | 0.0000 | 0.0000 |
| Comp Mole Frac (n-Butane) | 0.0000 | 0.0016 | 0.0016 | 0.0000 | 0.0000 |
| Comp Mole Frac (i-Pentane) | 0.0000 | 0.0007 | 0.0007 | 0.0000 | 0.0000 |
| Comp Mole Frac (n-Hexane) | 0.0000 | 0.0008 | 0.0008 | 0.0000 | 0.0000 |
| Comp Mole Frac (n-Pentane) | 0.0000 | 0.0006 | 0.0006 | 0.0000 | 0.0000 |
| Comp Mole Frac (n-Heptane) | 0.0000 | 0.0009 | 0.0009 | 0.0000 | 0.0000 |

Figure 5 (Continuation)

Compositions (continued)

* Specified by user.

| Name | 37 | 38 | 40 | 39 | GNL |
|---|---|---|---|---|---|
| Comp Mole Frac (Methane) | 0.9439 | 0.9439 | 0.7922 | 0.9439 | 0.9568 |
| Comp Mole Frac (Propane) | 0.0033 | 0.0033 | 0.0000 | 0.0033 | 0.0036 |
| Comp Mole Frac (i-Butane) | 0.0013 | 0.0013 | 0.0000 | 0.0013 | 0.0014 |
| Comp Mole Frac (Ethylene) | 0.0000 | 0.0000 | 0.0000 | 0.0000 | 0.0000 |
| Comp Mole Frac (Ethane) | 0.0162 | 0.0162 | 0.0001 | 0.0162 | 0.0175 |
| Comp Mole Frac (H2O) | 0.0000 | 0.0000 | 0.0000 | 0.0000 | 0.0000 |
| Comp Mole Frac (Nitrogen) | 0.0308 | 0.0308 | 0.2077 | 0.0308 | 0.0158 |
| Comp Mole Frac (Refrig-22) | 0.0000 | 0.0000 | 0.0000 | 0.0000 | 0.0000 |
| Comp Mole Frac (n-Butane) | 0.0016 | 0.0016 | 0.0000 | 0.0016 | 0.0017 |
| Comp Mole Frac (i-Pentane) | 0.0007 | 0.0007 | 0.0000 | 0.0007 | 0.0008 |
| Comp Mole Frac (n-Hexane) | 0.0008 | 0.0008 | 0.0000 | 0.0008 | 0.0009 |
| Comp Mole Frac (n-Pentane) | 0.0006 | 0.0006 | 0.0000 | 0.0006 | 0.0007 |
| Comp Mole Frac (n-Heptane) | 0.0009 | 0.0009 | 0.0000 | 0.0009 | 0.0009 |
| Name | 14 | 22 | 23 | 24 | 25 |
| Comp Mole Frac (Methane) | 0.4490 | 0.0000 * | 0.0000 | 0.0000 | -0.0000 |
| Comp Mole Frac (Propane) | 0.0193 | 0.0000 * | 0.0000 | 0.0000 | -0.0000 |
| Comp Mole Frac (i-Butane) | 0.1256 | 0.0000 * | 0.0000 | 0.0000 | -0.0000 |
| Comp Mole Frac (Ethylene) | 0.2833 | 0.0000 * | 0.0000 | 0.0000 | -0.0000 |
| Comp Mole Frac (Ethane) | 0.0000 | 0.0000 * | 0.0000 | 0.0000 | -0.0000 |
| Comp Mole Frac (H2O) | -0.0000 | 0.0000 * | 0.0000 | 0.0000 | -0.0000 |
| Comp Mole Frac (Nitrogen) | 0.1228 | 0.0000 * | 0.0000 | 0.0000 | -0.0000 |
| Comp Mole Frac (Refrig-22) | 0.0000 | 1.0000 * | 1.0000 | 1.0000 | 1.0000 |
| Comp Mole Frac (n-Butane) | -0.0000 | 0.0000 * | 0.0000 | 0.0000 | -0.0000 |
| Comp Mole Frac (i-Pentane) | -0.0000 | 0.0000 * | 0.0000 | 0.0000 | -0.0000 |
| Comp Mole Frac (n-Hexane) | -0.0000 | 0.0000 * | 0.0000 | 0.0000 | -0.0000 |
| Comp Mole Frac (n-Pentane) | -0.0000 | 0.0000 * | 0.0000 | 0.0000 | -0.0000 |
| Comp Mole Frac (n-Heptane) | -0.0000 | 0.0000 * | 0.0000 | 0.0000 | -0.0000 |
| Name | 50 | 51 | 49 | 31 | 26 |
| Comp Mole Frac (Methane) | 0.0000 | 0.0000 | 0.0000 * | 0.0000 | 0.0000 |
| Comp Mole Frac (Propane) | 0.0000 | 0.0000 | 0.0000 * | 0.0000 | 0.0000 |
| Comp Mole Frac (i-Butane) | 0.0000 | 0.0000 | 0.0000 * | 0.0000 | 0.0000 |
| Comp Mole Frac (Ethylene) | 0.0000 | 0.0000 | 0.0000 * | 0.0000 | 0.0000 |
| Comp Mole Frac (Ethane) | 0.0000 | 0.0000 | 0.0000 * | 0.0000 | 0.0000 |
| Comp Mole Frac (H2O) | 1.0000 | 1.0000 | 1.0000 * | 1.0000 | 1.0000 |
| Comp Mole Frac (Nitrogen) | 0.0000 | 0.0000 | 0.0000 * | 0.0000 | 0.0000 |
| Comp Mole Frac (Refrig-22) | 0.0000 | 0.0000 | 0.0000 * | 0.0000 | 0.0000 |
| Comp Mole Frac (n-Butane) | 0.0000 | 0.0000 | 0.0000 * | 0.0000 | 0.0000 |
| Comp Mole Frac (i-Pentane) | 0.0000 | 0.0000 | 0.0000 * | 0.0000 | 0.0000 |
| Comp Mole Frac (n-Hexane) | 0.0000 | 0.0000 | 0.0000 * | 0.0000 | 0.0000 |
| Comp Mole Frac (n-Pentane) | 0.0000 | 0.0000 | 0.0000 * | 0.0000 | 0.0000 |
| Comp Mole Frac (n-Heptane) | 0.0000 | 0.0000 | 0.0000 * | 0.0000 | 0.0000 |
| Name | 17 | 52 | 47 | 18 | 19 |
| Comp Mole Frac (Methane) | 0.0000 * | -0.0000 | -0.0000 | 0.0000 | 0.0000 |
| Comp Mole Frac (Propane) | 1.0000 * | 1.0000 | 1.0000 | 1.0000 | 1.0000 |
| Comp Mole Frac (i-Butane) | 0.0000 * | -0.0000 | -0.0000 | 0.0000 | 0.0000 |
| Comp Mole Frac (Ethylene) | 0.0000 * | -0.0000 | -0.0000 | 0.0000 | 0.0000 |
| Comp Mole Frac (Ethane) | 0.0000 * | -0.0000 | -0.0000 | 0.0000 | 0.0000 |
| Comp Mole Frac (H2O) | 0.0000 * | -0.0000 | -0.0000 | 0.0000 | 0.0000 |
| Comp Mole Frac (Nitrogen) | 0.0000 * | -0.0000 | -0.0000 | 0.0000 | 0.0000 |
| Comp Mole Frac (Refrig-22) | 0.0000 * | -0.0000 | -0.0000 | 0.0000 | 0.0000 |
| Comp Mole Frac (n-Butane) | 0.0000 * | -0.0000 | -0.0000 | 0.0000 | 0.0000 |
| Comp Mole Frac (i-Pentane) | 0.0000 * | -0.0000 | -0.0000 | 0.0000 | 0.0000 |
| Comp Mole Frac (n-Hexane) | 0.0000 * | -0.0000 | -0.0000 | 0.0000 | 0.0000 |
| Comp Mole Frac (n-Pentane) | 0.0000 * | -0.0000 | -0.0000 | 0.0000 | 0.0000 |
| Comp Mole Frac (n-Heptane) | 0.0000 * | -0.0000 | -0.0000 | 0.0000 | 0.0000 |

Figure 5 (Continuation)

* Specified by user.

Compositions (continued)

| Name | 32 | 45 | 43 | 44 | 33.1 |
|---|---|---|---|---|---|
| Comp Mole Frac (Methane) | 0.0000 | 0.0000 | 0.7922 | 0.9432 * | 0.9313 |
| Comp Mole Frac (Propane) | 1.0000 | 1.0000 | 0.0000 | 0.0033 * | 0.0030 |
| Comp Mole Frac (i-Butane) | 0.0000 | 0.0000 | 0.0000 | 0.0013 * | 0.0012 |
| Comp Mole Frac (Ethylene) | 0.0000 | 0.0000 | 0.0000 | 0.0000 * | 0.0000 |
| Comp Mole Frac (Ethane) | 0.0000 | 0.0000 | 0.0001 | 0.0161 * | 0.0149 |
| Comp Mole Frac (H2O) | 0.0000 | 0.0000 | 0.0000 | 0.0000 * | 0.0000 |
| Comp Mole Frac (Nitrogen) | 0.0000 | 0.0000 | 0.2077 | 0.0308 * | 0.0447 |
| Comp Mole Frac (Refrig-22) | 0.0000 | 0.0000 | 0.0000 | 0.0000 * | 0.0000 |
| Comp Mole Frac (n-Butane) | 0.0000 | 0.0000 | 0.0000 | 0.0016 * | 0.0015 |
| Comp Mole Frac (i-Pentane) | 0.0000 | 0.0000 | 0.0000 | 0.0007 * | 0.0007 |
| Comp Mole Frac (n-Hexane) | 0.0000 | 0.0000 | 0.0000 | 0.0010 * | 0.0009 |
| Comp Mole Frac (n-Pentane) | 0.0000 | 0.0000 | 0.0000 | 0.0007 * | 0.0006 |
| Comp Mole Frac (n-Heptane) | 0.0000 | 0.0000 | 0.0000 | 0.0014 * | 0.0013 |
| Name | 34 | 46 | 33 | 48 | 1 |
| Comp Mole Frac (Methane) | 0.9432 | 0.0000 | 0.9432 * | 0.0639 | 0.4400 * |
| Comp Mole Frac (Propane) | 0.0033 | 1.0000 | 0.0033 * | 0.0082 | 0.0200 * |
| Comp Mole Frac (i-Butane) | 0.0013 | 0.0000 | 0.0013 * | 0.0097 | 0.1400 * |
| Comp Mole Frac (Ethylene) | 0.0000 | 0.0000 | 0.0000 * | 0.0000 | 0.2800 * |
| Comp Mole Frac (Ethane) | 0.0161 | 0.0000 | 0.0161 * | 0.0087 | 0.0000 * |
| Comp Mole Frac (H2O) | 0.0000 | 0.0000 | 0.0000 * | 0.0000 | 0.0000 * |
| Comp Mole Frac (Nitrogen) | 0.0308 | 0.0000 | 0.0308 * | 0.0005 | 0.1200 * |
| Comp Mole Frac (Refrig-22) | 0.0000 | 0.0000 | 0.0000 * | 0.0000 | 0.0000 * |
| Comp Mole Frac (n-Butane) | 0.0016 | 0.0000 | 0.0016 * | 0.0184 | 0.0000 * |
| Comp Mole Frac (i-Pentane) | 0.0007 | 0.0000 | 0.0007 * | 0.0236 | 0.0000 * |
| Comp Mole Frac (n-Hexane) | 0.0010 | 0.0000 | 0.0010 * | 0.1673 | 0.0000 * |
| Comp Mole Frac (n-Pentane) | 0.0007 | 0.0000 | 0.0007 * | 0.0311 | 0.0000 * |
| Comp Mole Frac (n-Heptane) | 0.0014 | 0.0000 | 0.0014 * | 0.6685 | 0.0000 * |

Energy Streams Fluid Pkg: All

| Name | | W100 | W105 | W.160 | W.143 | W.153 |
|---|---|---|---|---|---|---|
| Heat Flow | (kW) | 8.510 | 6.100 | 3.399 | 5.251 | 0.2007 |
| Name | | Q162 | W.172 | Q145 | | |
| Heat Flow | (kW) | 8.838 | 0.1891 | 22.15 | | |

Unit Ops

| Operation Name | Operation Type | Feeds | Products | Ignored | Calc Level |
|---|---|---|---|---|---|
| 100 | Compressor | 1<br>W100 | 2 | No | 500.0 * |
| 105 | Compressor | 3<br>W105 | 4 | No | 500.0 * |
| 143 | Compressor | 22<br>W.143 | 23 | No | 500.0 * |
| 160 | Compressor | 17<br>W.160 | 18 | No | 500.0 * |
| 172 | Compressor | 42<br>W.172 | 43 | No | 500.0 * |
| 145 | Cooler | 23 | 24<br>Q145 | No | 500.0 * |
| 162 | Cooler | 18 | 19<br>Q162 | No | 500.0 * |
| 179 | Valve | 38 | 39 | No | 500.0 * |
| 142 | Valve | 6 | 7 | No | 500.0 * |
| 180 | Valve | 12 | 13 | No | 500.0 * |
| 148 | Valve | 24 | 25 | No | 500.0 * |
| 165 | Valve | 32 | 20 | No | 500.0 * |
| 188 | Valve | 45 | 46 | No | 500.0 * |
| 109 | Separator | 5 | 6 | No | 500.0 * |

Aspen Technology Inc. Aspen HYSYS Version 10 Page 5 of 6

Figure 5 (Continuation) Unit Ops (continued)

| Operation Name | Operation Type | Feeds | Products | Ignored | Calc Level |
|---|---|---|---|---|---|
| 109 | Separator | | 5.1 | No | 500.0 * |
| 120 | Separator | 39 | GNL<br>40 | No | 500.0 * |
| 177 | Separator | 34 | 48<br>35 | No | 500.0 * |
| 102 | LNG | 2<br>27 | 3<br>29 | No | 500.0 * |
| 107 | LNG | 4<br>28 | 5<br>30 | No | 500.0 * |
| Int. 109 | LNG | 5.1<br>7 | 9<br>8 | No | 500.0 * |
| 114 - Recuperador de Calor RM | LNG | 9<br>15 | 10<br>16 | No | 500.0 * |
| 115 - Pre-enfriador RM | LNG | 10<br>20 | 11<br>21 | No | 500.0 * |
| 117 - Recuperador Calor GN | LNG | 35<br>41 | 36<br>42 | No | 500.0 * |
| 119 - Sobre enfriador GN | LNG | 37<br>40 | 38<br>41 | No | 500.0 * |
| 118 - Evaporador RM | LNG | 36<br>13 | 37<br>14 | No | 500.0 * |
| 116 - Licuefactor RM | LNG | 11<br>14 | 12<br>15 | No | 500.0 * |
| 149 | LNG | 50<br>25 | 51<br>22 | No | 500.0 * |
| 156 | LNG | 51<br>52 | 26<br>17 | No | 500.0 * |
| 176 - Pre enfriador GN | LNG | 33<br>46 | 34<br>47 | No | 500.0 * |
| MIX-4 | Mixer | 16<br>8 | 1 | No | 500.0 * |
| MIX-1 | Mixer | 29<br>30 | 31 | No | 500.0 * |
| MIX-2 | Mixer | 21<br>47 | 52 | No | 500.0 * |
| MIX-3 | Mixer | 44<br>43 | 33.1 | No | 500.0 * |
| 153 | Pump | 49<br>W.153 | 50 | No | 500.0 * |
| TEE-2 | Tee | 26 | 27<br>28 | No | 500.0 * |
| TEE-1 | Tee | 19 | 32<br>45 | No | 500.0 * |

NATURAL GAS LIQUEFACTION PROCESS AND PLANT TO CARRY IT OUT

FIELD OF INVENTION

The present invention relates to a gas liquefaction process, particularly natural gas, and to a plant to carry it out, on a micro or small scale, in which the natural gas, after being dehydrated and conditioned for liquefaction, is refrigerated, according to the invention, through its passage by several counter-stream heat exchangers, successively until it is throttled through an expansion valve JT that expands it in a collector tank, simultaneously reducing the pressure and temperature of the fluid, thus achieving a final state formed as a liquid-vapor mixture. The liquid phase is separated and stored in the reservoir and the vapors are re-used by being vented to the counter-stream heat exchangers, producing cooling of the higher-pressure natural gas stream.

For gas cooling, there is, for example, a pre-cooling with a propane cycle and another multi-component refrigerant loop with pre-cooling also with propane, in addition to the recuperative heat exchangers from the natural gas flash process mentioned above.

The heat exchangers are all two-stream exclusively, and in particular the recuperative exchanger in the loop that employs mixed refrigerant is a helically wound tube-in-tube. The compressors used are also lubricated and an oil separation system is available to prevent it from reaching the coldest parts of the plant and thus avoid freezing and clogging of the loop.

BACKGROUND OF THE INVENTION

The liquefaction of gases, particularly for natural gas, has been known for years and is used to increase its density since in the liquefaction process its volume is reduced by approximately 600 times, which allows it to be transported efficiently in liquid form at cryogenic temperatures close to at −160° C. at atmospheric pressure or with slightly higher pressures and temperatures.

The most commonly used liquefaction systems to produce liquid natural gas include the "cascade refrigeration" process in which several independent refrigerant loops are used, as detailed in U.S. Pat. No. 5,611,216A, for example. Briefly, the cascade cycle consists of a series of heat exchangers with the feed gas, each exchange being at successively lower temperatures until the desired liquefaction is achieved. Cooling levels are obtained with different refrigerants or with the same refrigerant at different evaporation pressures. In general, cycles with propane, ethylene and natural gas itself are usually used in the cascade cycle. This system is considered very efficient in the production of liquid natural gas (LNG) as the operating costs are relatively low, however, the efficiency in operation is often offset by the relatively high investment costs associated with the expensive exchange of heat and compression equipment. Furthermore, a liquefaction plant that incorporates such a system may be impractical when physical space is limited, since its physical components are relatively large and are preferably applied to large production capacities.

Another possibility is to use an "expansion cycle," in which natural gas is compressed to a selected elevated pressure, cooled, and then allowed to expand through an expansion turbine in a theoretically isentropic manner, thereby producing work and reducing the temperature of the feed gas. The low-pressure, low-temperature feed gas then recuperative manner exchanges heat to effect gas liquefaction. These cycles are derived from the Claude process, and can use the product gas for expansion or use a closed cycle with expansion and refrigerate the gas in heat exchangers until its liquefaction. The patent US2015211788 (A1) is cited as an example.

Other liquefaction systems are based on the Linde-Hampson process, similar to the one mentioned above, but with the difference that the expansion process is carried out using restrictions or expansion valves in an isenthalpic manner and take advantage of the Joule-Thomson effect as in patent US2014318178 (A1).

Systems that operate with the reverse Stirling cycle, which is based on Philips' research in the 1950s with the development of a laboratory-scale closed-loop gas refrigeration machine, as described by JWL Köhler and CO Jonkers, in Philips Technical Review. 16 (1954). (GB719879A; U.S. Pat. No. 2,856,756A) are also used in liquefaction processes on smaller scales. The patent WO2007067093 (A1) or the best-known commercial case developed by the company Stirling Cryogenics, based on the referred Philips patent, are mentioned as an example.

There are also liquefaction systems that use a mixture of refrigerants called mixed refrigerants. The principles of these single-flow mixed refrigerant systems were first described by A. P. Kleemenko, "One Flow Cascade Cycle", Minutes of the 10th International Refrigeration Congress, Copenhagen, 1, 34-39 (1959), Pergamon Press, London. Multi-component refrigerants are used in liquefaction plants as an effective manner to achieve sufficiently low temperatures, as Kleemenko described for the cooling and liquefaction of various components of natural gas, based on the use of multi-flow heat exchangers. As an example of natural gas liquefaction systems that operate based on this principle, the following patents U.S. Pat. Nos. 3,914,949, 3,932,154, 3,763,658 and 6,253,574 are mentioned.

Regarding the optimization of refrigerant mixtures, it was studied by several authors, including Williams A. Little, who presented patent U.S. Pat. No. 5,644,502A "Method for efficient counter-current heat exchange using optimized mixtures (1997)". As for small liquefaction plants with the use of mixed refrigerants, there is, for example, the one corresponding to patent U.S. Pat. No. 8,806,891B2, which also uses two-stream exchangers, but with plates, and in this case the mixed refrigerant flow expands and divides into two parallel streams, one of them for the liquefaction of natural gas and the other for the condensation of the mixed refrigerant itself.

Another embodiment that uses two-stream exchangers and mixed refrigerant is the one detailed in document U.S. Pat. No. 6,751,984, which is provided with more phase separation stages and therefore a greater number of exchangers than the one referred to above, but also provides for the division of the flow of mixed refrigerant in two parallel streams, such that the main heat exchanger does not receive equal flows in the high-and low-pressure streams.

Regarding liquefaction systems with pre-cooling, there is a precedent in U.S. Pat. No. 3,763,658, which provides pre-cooling with propane with three stages of pressure for natural gas, and two stages for pre-cooling of the mixed refrigerant, In this case the main heat exchanger is much more complex and multi-stream.

Another precedent is patent US20080141711A1, which describes a hybrid natural gas liquefaction cycle with propane pre-cooling, in this case, there are two mixed refrigerant loops and pre-cooling with propane.

The liquefaction processes and plants disclosed in the aforementioned Documents are focused on large productions in the case of cascade cycles, and isentropic or isenthalpic expansion systems, with the management of high pressures in the refrigeration cycles and the natural gas itself and they generally have smaller equipment with mixed refrigerant systems and Stirling systems, but in the latter cases, in general, the performance achieved decreases compared to the higher capacity plants.

SUMMARY OF THE INVENTION

It is therefore an object of the present invention to provide a liquefaction process of natural gas and a liquefaction plant that uses a novel combination and association of exchangers in series, together with pre-cooling processes, a refrigeration loop with refrigerant mixed and heat recovery from a natural gas flash process that substantially modify the aforementioned thermodynamic cycles in order to achieve acceptable and economically viable performance of the liquefaction plant with the present invention, even with small units, operating with relatively low pressures, both in the auxiliary refrigeration loops and in the main gas loop to be liquefied and using refrigeration compressors with lubrication.

According to an object of the invention, the process and the liquefaction plant have taken into account the technical recommendations of the manufacturers of plate heat exchangers in order to avoid thermal fatigue processes that limit rapid temperature changes and the difference maximum temperature at around 100K and 60K in cases of pressure cycles, so according to the preferred embodiment the main recuperative heat exchanger in a mixed refrigerant loop is of the helical tube-within-tube type for better adaptation to the process considering that the aforementioned temperature gradient would be exceeded.

According to one aspect of the invention, a process is provided for the natural gas liquefaction, wherein, after being pre-treated for liquefaction, it is subjected to the novel process comprising the stages of:

conveying said pre-treated gas at a pressure between 150 and 200 psia, and a temperature between 15 and 20° C., to a first pre-cooling heat exchanger wherein it is cooled by exchanging heat in counter-stream with a cycle of propane, thus being refrigerated to a temperature between −10 and −15° C., directing the gas from the previous stage to a higher hydrocarbon separator, which separates a fraction of liquefied gas at the bottom, when there are condensable traces and the dry gas is released at the top of it, conveying the dry gas separated in the upper part of the previous stage to a cool box, to circulate it through a second recuperative type counter-stream heat exchanger, thus producing cooling up to a range of −15 to −30° C., conveying the natural gas from the previous stage to a third counter-stream heat exchanger, producing additional counter-stream cooling with a mixed refrigerant loop, until partial liquefaction of said gas is achieved at a temperature between −130 and −140° C., conveying the partially liquefied gas from the previous stage to a fourth recuperative heat exchanger, increasing its percentage of liquefaction and cooling, within a temperature gradient of 0.5 to 1° C., as heat is exchanged in counter-stream with the gas itself at low pressure.

passing the flow of liquid natural gas thus achieved through a throttle valve, producing its expansion in a cryogenic collector tank, wherein its pressure decreases to a range between 45 and 50 psia, and reaches a temperature of −148 to −150° C., producing partial vaporization, collecting and storing the liquid fraction in said cryogenic collector tank, and conveying the vapors from the previous stage at low pressure to the fourth recuperative heat exchanger and then to the second natural gas exchanger mentioned above to achieve recuperative cooling, extracting the liquefied natural gas from the cryogenic collector tank, finally compressing said portion of partially vaporized gas that produced the recuperative cooling in a compressor, to be injected together with the pre-treated natural gas from the first stage, thus re-starting the process.

According to another aspect of the invention, a natural gas liquefaction plant is provided having:

A) a first loop of pre-treated natural gas that is supplied at a pressure of 150 to 200 psia and is led to a first heat exchanger that pre-cools the natural gas with a propane cycle, then the gas is led to a phase separator of phases that retains the condensable traces if there are higher hydrocarbons and the gas fraction is directed to a cool box that has a liquefaction column made up of a second recuperative type counter-stream heat exchanger, a third counter-stream heat exchanger that exchanges heat with a mixed refrigerant loop and a fourth recuperative heat exchanger, connected in series in that order, said fourth heat exchanger being connected through a throttle valve with the inlet of a cryogenic collector tank that accumulates the liquefied natural gas, and the gas fraction is vented from the tank to produce recuperative cooling, passing through the forth and then the second exchanger respectively at low pressure, to finally be re-injected by a compressor along with the pre-treated gas stream.

B) a second mixed refrigerant loop that has a low pressure compressor for the mixed refrigerant, the same being connected, through an oil separator and first mixed refrigerant heat exchanger, with a high pressure compressor for the refrigerant mixed having an outlet connected to an oil separator in series with a second mixed refrigerant heat exchanger, (a two-stage compressor with intermediate cooling may also be used) extending from said second heat exchanger to a coalescing filter that conducts the mixed refrigerant to a third recuperative heat exchanger that we call mixed refrigerant heat recovery, which has an outlet that leads the refrigerant to a fourth heat exchanger that acts as a pre-cooler of the mixed refrigerant with an auxiliary propane cycle, which in turn leads to a fifth recuperative exchanger that acts as a liquefier for the mixed refrigerant, extending from its outlet a condensate line that passes through a throttle valve that allows the expansion of the mixed refrigerant in a heat exchanger or mixed refrigerant evaporator through which the natural gas passes in counter-stream as mentioned above. The mixed refrigerant then passes at low pressure through the mixed refrigerant liquefier and subsequently through the mixed refrigerant heat recovery, producing recuperative refrigeration in both and from there it returns to the low-pressure compressor, said mixed refrigerant heat recovery being said mixed refrigerant pre-cooler, said mixed refrigerant liquefier and mixed refrigerant evaporator arranged within said cool box, C) a third pre-cooling loop with propane that comprises a single-stage compressor that draws in the refrigerant at low pressure and drives it to an oil separator connected to an air-cooled condenser and from there, a streamline exits in a liquid state which is divided into two, one of them goes to said natural gas pre-cooler to which it enters through a thermostatic valve that allows its expansion therein and the second streamline goes to another thermostatic valve that expands the refrigerant in the mixed refrigerant pre-cooler. The low-pressure propane outlets of both exchangers are unified again and absorb residual heat from an auxiliary water/glycol refrigerant, over-heating before being drawn in again by the compressor, and D) a fourth loop with R22 Refrigerant or another similar one intended to cool the mixed refrigerant after each compression stage through a water/glycol auxiliary fluid. This loop comprises a compressor that receives the R22 refrigerant vapors at low pressure and discharges them compressed into an oil separator associated in series with an air-cooled condenser, whose outlet leads to a thermostatic expansion valve that expands the refrigerant in an evaporator and subsequently the R22 refrigerant is drawn in again by the compressor. This evaporator cools the water/glycol auxiliary fluid and maintains it between 5 and 9° C., which is pumped from a tank and is diverted into two for the first and second mixed refrigerant heat exchangers, which are in parallel with respect to this flow and return the auxiliary fluid later to the tank.

The small-scale plant or micro liquefaction plant object of the invention is focused on covering small requirements for the production of liquid natural gas of the order of 1500 to 2000 L/day of LNG, achieving acceptable and economically viable yields as well as reducing the cost of the plant compared to other options.

To date, this production range is not addressed by the commercial options available on the market, with the exception of the equipment produced by Stirling Cryogenics with four-cylinder Stirling cryogenerators, but these plants require an auxiliary chilled water supply system to its operation.

The advantage of the proposed invention with respect to the mentioned option is that the compressors used are normal refrigeration with lubrication, and various market options can be used, and therefore of greater accessibility and lower cost, with advantages in terms of maintenance due to being a well-known technology. In addition, the energy consumption of the proposed invention is lower and everything is integrated into the system, with a simple and robust level of automation achieved in this embodiment that allows simple operation and start-up of the mini plant in a short time.

Thus, the equipment will be able to serve markets linked to small isolated fields that do not have transportation infrastructure, allowing the development of emerging fields as well as the application for the reduction of gas flaring in flares when it is obtained associated in wells or in the case of biogas obtained from landfills.

The production of LNG in a distributed manner in the places of requirement for vehicular use also has the advantage of reducing storage and transportation costs, when gas is available on site.

Furthermore, a small plant, or mini plant according to the invention can be assembled in a factory and transported directly to the installation site in a container, with several being able to operate in parallel if necessary.

The process and plant according to a preferred embodiment of the invention offers a possibility of liquefaction of gas, preferably natural gas on a micro scale, with rates of 1500 to 2000 L/day, using for this purpose a compact and versatile plant that requires supply of gas with relatively low pressure of the order of 150 to 200 psia and aims to obtain acceptable yields.

Therefore, the present invention is directed to a process and equipment for natural gas liquefaction that overcomes the difficulties and inconveniences of prior art devices.

The development of a main thermodynamic process is proposed to be followed by Natural Gas, and three other auxiliary cooling systems that are detailed below:

According to the invention, a first loop or main system is provided, the working fluid is the already properly conditioned natural gas that is first pre-cooled with an auxiliary refrigerant at a pressure level, propane (R290) being adopted in the preferred embodiment, in a second stage, recuperative refrigeration is available with the natural gas itself at lower pressure in a counter-stream heat exchanger, in a third stage the gas is cooled by a mixed refrigerant cycle, initiating its condensation, in a fourth stage there is another process of recuperative heat exchange with the low pressure gas itself, which allows the liquefaction of the gas to continue at high pressure or to sub-cool it if it has already reached the state of saturated liquid and finally said flow is throttled in a Joule-Thompson valve and expands in a collector tank in which it is partially vaporized. The liquid fraction accumulates in the collector tank and the gaseous fraction is vented from the tank to produce the recuperative refrigeration mentioned above.

A second loop or secondary refrigeration system, or mixed refrigerant loop, is also provided, which is a self-cooled cascade system with at least one mixed refrigerant (RM) composed of natural refrigerants, such as nitrogen, methane, ethylene, propane and butane in the preferred embodiment, but adding pre-cooling thereof with a propane cycle (R290). The compression of the mixed refrigerant is carried out by combining at least two compressors in series, or a two-stage compressor, with intermediate cooling after each compression process in order to avoid high temperatures resulting from the type of fluid used, with separation of oil. High-pressure intermediate and post-compression cooling in the mixed refrigerant system is carried out with plate heat exchangers and a cold water-glycol system.

Standard industrial refrigeration compressors with lubrication can be used, available commercially, which are much more economical than those free of oil, and the heat exchangers required are of the helically wound copper tube-in-tube type and with relatively low working pressures. They do not require very high thicknesses, and their construction is feasible in a simple manner by having the appropriate bending machine. In the self-cooled cascade system, it is proposed to reduce the phase separators to a minimum, adopting only one that will mainly have the purpose of eliminating traces of oil that may be carried along, as well as some fraction of the refrigerant mixture already condensed at said point. The RM system also has two recuperative exchangers in which the refrigerant is cooled and liquefied respectively before expanding through a Joule-Thomson valve in a counter-stream evaporator wherein it cools the natural gas, and returns to the compressor, previously passing through the recuperative heat exchangers in low pressure.

The plant of the invention also has a third system or refrigeration loop, which is the pre-cooling loop for the natural gas and the mixed refrigerant, which is carried out with a propane cycle with a pressure level in the preferred embodiment. The propane flow (R290) is compressed and after the corresponding oil separation, it gives off heat to the environment in an air-cooled condenser, subsequently it is divided into two streams, one of them to cool the supply natural gas and the other to cool the mixed refrigerant. In both cases, counter-stream exchangers are used as evaporators and the expansion is regulated with thermostatic valves. After expansion, the low pressure streams join and pass to another heat exchanger wherein residual heat is absorbed, cooling a water/glycol solution and finally the flow is drawn in by the propane compressor.

The water/glycol auxiliary refrigerant is cooled by a fourth R22 refrigerant system in this embodiment and can be any other substitute refrigerant with less environmental effect. The propane system (R290) also collaborates in this cooling of the water/glycol in a differential manner as mentioned above.

The pre-cooling of the mixed refrigerant and natural gas increases the performance of the plant and the cooling of the mixed refrigerant cycle with water-glycol provides greater stability to the thermodynamic cycle against the variation of environmental conditions, enabling operation in hot climates.

The entire main low temperature system is isolated in a vacuum cool box with sprayed insulating material (expanded perlite), or other similar cryogenic insulating medium in the preferred embodiment.

There is also a buffer tank in the mixed refrigerant loop that allows the mass that effectively operates in the cycle to be regulated by means of pressure-controlled solenoid valves, thereby eliminating over-pressures in the system during the start-up process and optimizing its operation in a stable state.

The natural gas, with an intake pressure of between 150 and 200 psia, is expected to be refrigerated until it reaches approximately −130 to −140° C. and then expanded in a flash tank-collector wherein it is expected to recover 85 to 92% in the form of LNG, depending on the pressure in it, and the remainder is used as a counter-stream refrigerant in exchangers when it is vented or for subsequent re-circulation using a compressor. In that case, the composition of the incoming natural gas must be taken into account, since if there is nitrogen content in it, the re-circulating stream would become enriched in such component.

Liquefied Natural Gas (LNG) is stored at a pressure of between 45 and 50 psia and is regularly removed when the collector tank is filled.

BRIEF DESCRIPTION OF THE DRAWINGS

The figures that help to better understand the scope of the invention are briefly described below:

FIG. 5 shows a table containing all the simulation values adopted for an example with the preferred configuration of FIG. 1. The software used corresponds to Aspen Hysys V10. Other pressure and temperature conditions may be present in the different streams depending on the composition of the mixed refrigerant mixture used and the composition of the natural gas to be liquefied.

DETAILED DESCRIPTION OF THE INVENTION

Subsequently both the liquefaction process and the plant will be described in detail and jointly given that said process is preferably carried out in the facilities and equipment of said plant, said process and plant being both objects of the present invention. However, it must be understood that the invention is not limited to said process-plant set, but that the process of the present invention can be carried out in other types of similar plants without any inconvenience, as long as they do not deviate from the process of the object and spirit of the invention.

Figure 1:
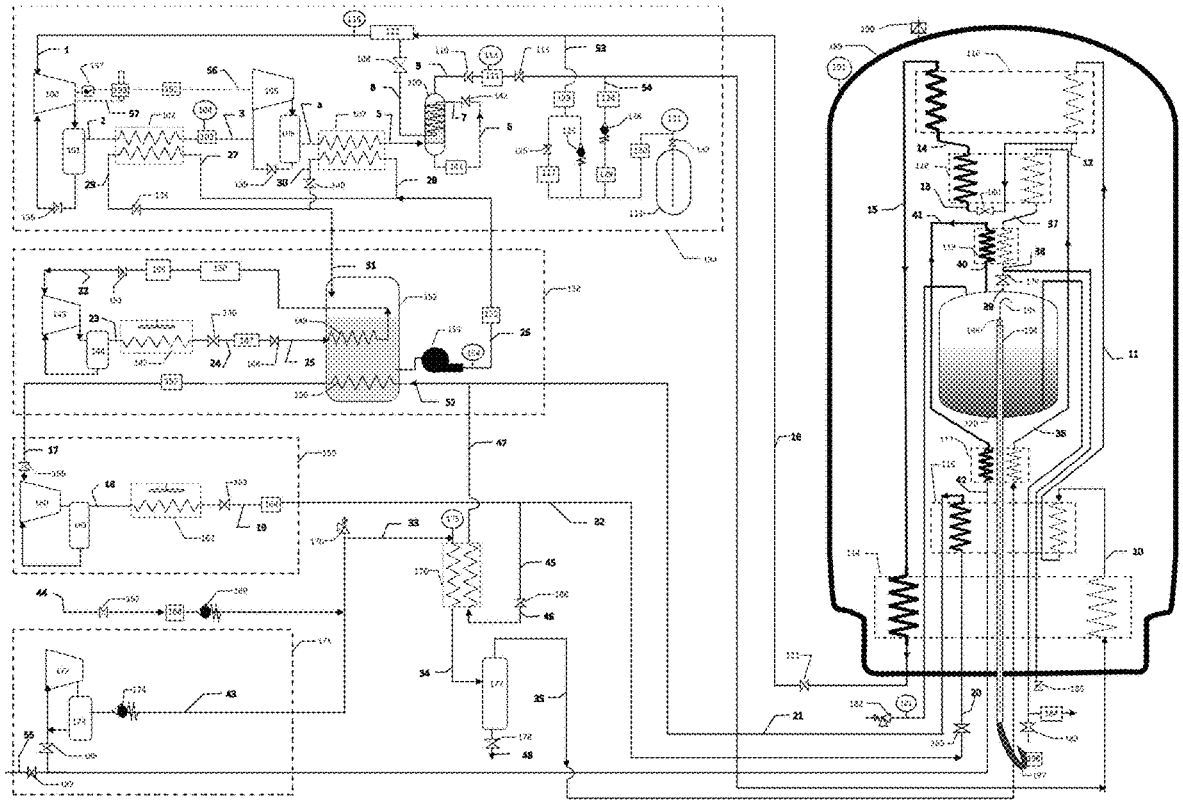
FIG. 1 shows a view of the thermodynamic scheme of the small-scale plant or mini gas liquefaction plant according to the present invention.

FIG. 1 illustrates four cooling sub-systems which are; the loop that the gas follows, particularly the first natural gas compression system or loop (171), a second mixed refrigerant system or loop (134), a third pre-cooling system or loop of the natural gas and the mixed refrigerant with propane (159), and a fourth auxiliary refrigerant system or loop (158) that provides water/glycol cooling with R22 in the preferred embodiment.

The natural gas previously treated and conditioned for liquefaction in facilities known to the art, which basically consist of the elimination of humidity, mercury, sulfur, etc., and which are not included in this scheme, enters through stream 44 with a pressure of between 150 and 200 psia and a temperature of between 15 and 20° C. to the plant passing through a manoeuvre valve 167, a filter 168 and a check valve 169, and is added to the re-circulation stream 43, subsequently entering as flow 33 to the natural gas pre-cooler 176 consisting of a plate counter-stream heat exchanger that is cooled by a propane cycle to a temperature of between 10 and −15° C. In this inlet line there is a safety valve 170 calibrated to avoid over-pressures in the system and a pressure gauge 175 to display the pressure. Subsequently, the gas is directed as a stream 34 to the upper hydrocarbon separator 177, which separates the liquid fraction 48 from the bottom through a valve 178, in case there are propane-butane fractions or traces of higher hydrocarbons that condense. This device consists of a tank with a tangential gas inlet in the lower third of the same, such that the separation of the liquid fractions is favored, and internally it has a grate over said inlet that acts as a support for a specific high-surface filling material that favors condensation (tiles, stainless filler or other similar). The gas outlet is carried out through the upper part of the same, wherein the stream 35 is directed to the cool box or cool box 189 wherein the heat exchangers of the liquefaction column are installed, first entering a recuperative counter-stream type heat exchanger 117 herein called natural gas heat recovery, in which it is cooled in a recuperative manner until it reaches between −15 and −30° C., giving off heat to the low pressure gas stream that comes from the flash effect described later.

Subsequently, the high-pressure natural gas 36 is directed to another counter-stream heat exchanger 118 wherein heat transfer occurs to the mixed refrigerant as it cools and liquefies at between −130 and −140° C. Subsequently, it is directed as current 37 to another recuperative heat exchanger that we call the natural gas cooler 119, wherein its liquefaction continues, or it is even over-cooled, generally varying its temperature between 0.5 to 1° C. as it exchanges heat with the stream of the gas itself at low pressure. Subsequently, the flow of liquid natural gas 38 is throttled in a Joule-Thomsom valve consisting of a capillary tube 179 in the preferred embodiment, and is expanded in a cryogenic collection tank 120, wherein its pressure and temperature decreases to −148 to −150.° C., flow 39 partially vaporizing (flashing). The liquid fraction is collected in the tank and the separated natural gas vapors 40 re-enter the natural gas over-cooler 119 in counter-stream and leave it as stream 41 to pass to the natural gas heat recovery 117, from which it exits as stream 42 and finally that portion of vented gas passes through the manoeuvre valve 186 and is compressed in the compressor 172, then it passes through the helical oil separator with float 173, the check valve 174 and is re-injected as united stream 43 to stream 44, thus restarting the process. If it is desired to use the percentage of vented gas for generation of electrical energy or other uses, it can be released by the manoeuvre valve 187 as stream 55, the valve 186 must be obstructed and then the compressor 172 is not used, persisting the supply of natural gas by 44.

The extraction of liquefied natural gas (LNG) from the cryogenic collector tank 120 is carried out manually by means of the valve 183 or intermittently by means of the solenoid valve 184, automatically by weighing the gas contained in the tank 120 or by a suitable level sensor installed therein.

The tank 120 also has a safety valve 182 that limits the pressure inside it and a pressure gauge 181 that allows the pressure to be displayed.

As a safety measure to prevent over-filling of the collector tank, there is a stainless-steel over-flow tube 194 that comes out of the cool box and ends in a copper coil 197 closed at the end so that when the liquid reaches the height of the opening of the conduit 194, it flows to the lower end wherein a temperature sensor 198 is installed, which will cause the entire unit to stop. Said over-flow tube has another tube 195 internally that ends at the top of the tank in a downward curve and goes to the bottom of the tube 194 to equalize the pressures and avoid obstructions due to the formation of pressurized bubbles therein. At the junction of both tubes there is an inverted cone 196 held by the central tube that prevents the entry of condensed LNG from the smaller diameter tube.

The manoeuvre valve 185 is installed for its use in the event that the natural gas loop becomes clogged by humidity, to perform a reverse cleaning of the system. However, it would be rare for this to occur as long as the natural gas pre-treatment system is appropriate for its characteristics.

In the second mixed refrigerant system or loop 134, a simple low-pressure compressor 100 with lubrication compresses a stream of mixed refrigerant (RM) and discharges the mixture at a pressure of approximately 120 to 140 psia as hot vapor with oil suspended in form of fine droplets to an oil separator for conventional refrigeration with float 101, preferably with a helical system to reduce oil transfer to the high-pressure compressor, wherein the droplets are collected until reaching a certain established level that activates the float and returns to the compressor 100 the separated oil through the manoeuvre valve 136 which remains normally open. Meanwhile, the refrigerant as hot vapor 2 leaves the oil separator and enters a water/glycol cooled heat exchanger 102 wherein the temperature of said mixed refrigerant is reduced.

Subsequently, the refrigerant stream 3, after passing through a filter 103 with a manometer 104, is drawn in by the second high-pressure compressor 105, which is a simple lubricated compressor, which raises the pressure of the refrigerant to its final value of between 275 and 300 psia.

The refrigerant mixture leaves the compressor 105 as a hot vapor and passes to an oil separator 106 similar to the previous one wherein the oil that returns to the compressor 105 through the manoeuvre valve 139 that remains normally open is retained, and the mixed refrigerant 4 leaves the separator to enter a water/glycol cooled exchanger 107 to reduce its temperature to the final pressure.

The refrigerant stream 5 then enters a coalescing filter and cyclonic separator 109 to ensure the retention of traces of oil that could accompany the mixed refrigerant, wherein the liquid phase fraction of any of the components of the refrigerant with high boiling point, along with traces of oil, at the bottom of the separator.

Said high-pressure liquid passes through the filter 141 and as flow 6 passes through a capillary 142, expanding at the suction pressure of the low compressor 100, reducing its temperature, which allows it to absorb heat from the vapor fraction of the mixed refrigerant by passing through a coiled tube inside the separator 109, thereby achieving a small reduction in its temperature, favoring better filter performance. Said filter was constructed following the recommendations of Williams A. Little (document U.S. Pat. No. 5,724,832). However, commercial filters such as the TEMPERITE™ series 300 and 900 line can also be used for ultra-low temperatures. The mixed refrigerant stream in the gaseous state exits at the top as stream 9.

The refrigerant stream 9 then passes through the manoeuvre valve 110, the dehydrator filter 111 with pressure gauge 112, and the manoeuvre valve 113, to go to the mixed refrigerant heat recovery 114 inside the cool box 189, wherein its progressive cooling effectively begins by giving off heat to the return stream of low-pressure mixed refrigerant 15 that operates in counter-stream.

The mixed refrigerant stream 10 is subsequently directed to the mixed refrigerant pre-cooler 115 wherein it reduces its temperature by exchanging heat through the refrigeration provided by the propane cycle (R290) that circulates in counter-stream 20, after expanding in the thermostatic valve 165.

The mixed refrigerant stream 11 pre-cooled by the expansion of propane (R-290) is led to the mixed refrigerant liquefier 116 wherein it is condensed to state 12 by the low-pressure mixed refrigerant stream 14 circulating in counter-stream. Subsequently, the mixed refrigerant in liquid state is throttled through the capillary tube 180 and expands as flow 13 in the mixed refrigerant evaporator 118 wherein it cools the natural gas flow 36 whose loop was explained above. Upon leaving the mixed refrigerant 14, the low-pressure evaporator circulates through the liquefier 116 as mentioned and subsequently, as stream 15, passes through the heat recovery 114 and then through the manoeuvre valve 121, heading as flow 16 to the particle filter 122 with pressure gauge 135, and joins the flow 8 that passes through the manoeuvre valve 108, thus forming stream 1 that enters the compressor 100, subsequently repeating the process.

It is necessary to highlight that the mixed refrigerant generally has a large percentage, or even all of its mass, in a vapor state when the equipment is not operating and with a warm room temperature, which is why it is necessary to incorporate a buffer tank into the system 133 to allow the storage of the refrigerant and reduce its pressure in such a condition. This tank is interconnected to the Mixed Refrigerant system on the low-pressure side by means of stream 53 through a filter 123 that feeds in parallel to a check valve 125 and a capillary 126 associated in series with a solenoid valve 127. Thus, the mixed refrigerant enters the tank through the check valve 125, provided that the internal pressure is lower than the system pressure on the low side and when the equipment is not operating due to the room temperature that increases the pressure in the system. The mass output is electrically controlled based on the low pressure through the solenoid valve 127, which allows, through the capillary 126, the progressive and controlled entry of the mixed refrigerant into the operating cycle as needed. Both lines are interconnected to the buffer tank through a filter 130 and the manoeuvre valve 132, which must always remain open except in cases of maintenance and repairs. A pressure gauge 131 allows the pressure in the tank to be displayed, which has an internal tube that allows the extraction of mass that may remain condensed in it, in order to avoid the segregation of the mixed refrigerant in the system. The buffer tank 133 is also interconnected to the high-pressure side of the loop by means of the stream 54 and the filter 124, the check valve 128, the solenoid valve 129 and the filter 130. Thus, when the system begins its start-up, the high pressure of the system can be controlled with the opening of 129, which allows part of the mixed refrigerant to be stored in the buffer tank 133 at high pressure. As the system reaches lower temperatures in cool box 189, the density of the mixed refrigerant in average value in the system increases and the pressures are reduced, such that mass can be added to the system from the buffer tank. Monitoring and control of pressures is achieved with a programmable electronic controller and recorder. Thus, the mass of useful refrigerant in the system can be continuously modulated and check that the high and low operating pressures are maintained in acceptable, safe ranges and according to design that do not cause over-loads in the compressors.

It should be noted that the high pressure of the system is the one that presents the greatest variability during the cooling process in case the proposed buffer tank 133 is not available and it is of utmost importance to try to maintain the high and low operating pressures relatively constant in order to obtain adequate performance for the system design conditions, since in general the composition of the optimized mixture of the mixed refrigerant depends on these conditions as demonstrated in the document by Williams A. Little (U.S. Pat. No. 5,644,502 A). In addition, if the high pressure in the system drops substantially due to the cooling effect, the cooling effect is also reduced, which is avoided with the solution adopted.

It is mentioned that to solve a small carry-over of oil from the compressor 100 to the high pressure 105, there is an oil equalization line 56 at the height of the sight glass of the compressor 105 that is connected to a filter 192, subsequently to a pressure differential regulator 193 (type Sporlan Y1236C), and finally to a level control system with float 137 in the low-pressure compressor 100. The pressure regulating valve takes reference from the crankcase pressure of the compressor 100 through a line 57.

In the third system or loop for pre-cooling the natural gas and the mixed refrigerant 159, propane (R290) is used as a refrigerant in the preferred embodiment, in order to reduce the temperature of the natural gas in the natural gas pre-cooler 176 before entering the cool box liquefaction column 189 and also to reduce the temperature of the mixed refrigerant in the mixed refrigerant pre-cooler 115. To do this, an oil-lubricated single-stage compressor 160 compresses a low-pressure return stream 17. The refrigerant leaves the compressor 160 as hot vapor with traces of oil suspended in the form of fine droplets and enters a conventional refrigeration oil separator 161 wherein the oil is retained and returned to the compressor 160, and the refrigerant passes as flow 18 to the air-cooled condenser 162 and subsequently directed to a manoeuvre valve 163, a liquid dehydrator filter 164 and the stream 19 is divided into two. One stream 45 is directed to the thermostatic expansion valve 188 and then as flow 46 to the natural gas pre-cooler 176, while the second stream 32 passes through the thermostatic expansion valve 165 and enters the mixed refrigerant pre-cooler. 115 as stream 20, absorbing heat in both exchangers.

The low pressure streams 21 and 47 of the propane refrigerant (R290) join together to enter as stream 52 to the heat exchanger 156 in order to absorb heat residually, reducing the temperature of the water in the reservoir 152 and raising its own temperature to over-heat the propane refrigerant (R-290) in order to ensure that there is no return of liquid to the compressor 160, which again draws in the refrigerant flow through line 17, which passes through the sight glass 157 and the manoeuvre valve 166, thus closing the cycle.

The water/glycol auxiliary refrigerant used in the two cooling stages of the mixed refrigerant is cooled by the fourth auxiliary refrigerant system or loop 158 of R22 refrigerant in the present embodiment. To do this, a simple compressor lubricated with oil 143 draws in the R-22 refrigerant vapors from line 22, compresses it and sends it to an oil separator with a float 144, then as stream 23 it enters the atmospheric condenser with forced air cooling 145 wherein it gives off heat to the environment, then passes through a manoeuvre valve 146 and a dehydrator filter 147, and enters the thermostatic expansion valve 148 as a stream 24 from which it exits at lower pressure as stream 25 and enters the evaporator 149 submerged in a water/glycol reservoir 152 in which it absorbs heat and cools the mentioned liquid. The refrigerant returns to the compressor 143 through line 22, after passing through a liquid receiver 150, a particle filter 199 and a manoeuvre valve 151.

A pump 153 draws in the water/glycol from the reservoir 152 and drives it through the filter 155, as flow 26, the pressure can be verified in the pressure gauge 154, and enters the plate exchangers 102 and 107 of the mixed refrigerant system as streams 27 and 28 respectively. The water/glycol leaves them through pipes 29 and 30, passing through the flow regulating valves 138 and 140 respectively and returns through pipe 31 to the reservoir.

It is important to note that all the main heat exchangers 114, 115, 116, 117, 118, 119 and the collector tank 120 are thermally insulated in the cool box 189 that has internally expanded perlite as an insulator in the preferred embodiment that is subjected to vacuum and that can be verified in a vacuum gauge 191. The cool box also has a rupture disc 190 for safety in case of any failure in the exchanger system or the collector tank 120.

To start up the system, the water/glycol cooling system is first started, then when the temperature of 7° C. is reached, the propane system (R290) begins to operate, which pre-cools the mixed refrigerant and the natural gas. When −10° C. is reached in the propane loop at the outlet of the mixed refrigerant pre-cooler 115, the low pressure mixed refrigerant compressor starts and after 2 minutes the high mixed refrigerant compressor starts. Finally, the natural gas system is started when the temperature of −100° C. is reached in the expansion of the mixed refrigerant. In this sequential manner, start-up over-pressures are reduced and the start-up of the mini plant is optimized.

Figure 2:
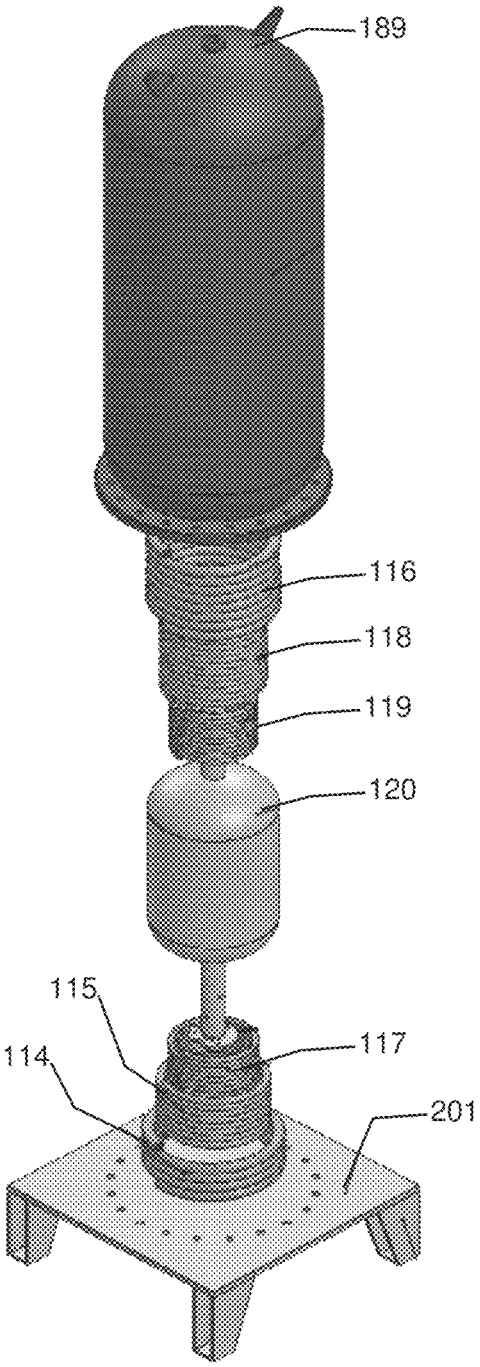
FIG. 2 shows a general perspective view of one embodiment of the cool box, commonly called "cool box" and the main heat exchangers and LNG storage tank.

FIG. 2 shows a general perspective view of an embodiment of the cool box and the main heat exchangers and LNG storage tank located therein. The cool box can be constructed in a dismantled manner, consisting of a base 201 that supports its cover 189, fully adjusted with a flange to allow sealing, but it could also be of the completely sealed type, since there are no moving parts in it susceptible to maintenance. The heat exchangers installed in it are all counter-stream of the concentric helically wound copper pipe type and are mounted on the base 201, and the connections are all made through the base to the outside of the cool box. The exchangers are arranged in two groups, three below the LNG collector tank 120 and three above it, in both cases the exchangers are concentric, with the mixed refrigerant heat recovery 114 being at the bottom, inside of it there is the mixed refrigerant pre-cooler 115 and inside the natural gas heat recovery 117. Above the tank are the mixed refrigerant liquefier 116, the mixed refrigerant evaporator 118 and the natural gas over-cooler 119, cited from largest to smallest diameter. The collector tank 120 has a central stainless steel support pipe that runs through it and Teflon bushings are installed inside it, which adjust to another central pipe that holds it to the base. The tank therefore has a small possibility of movement to make it possible to weigh it.

Figure 3:
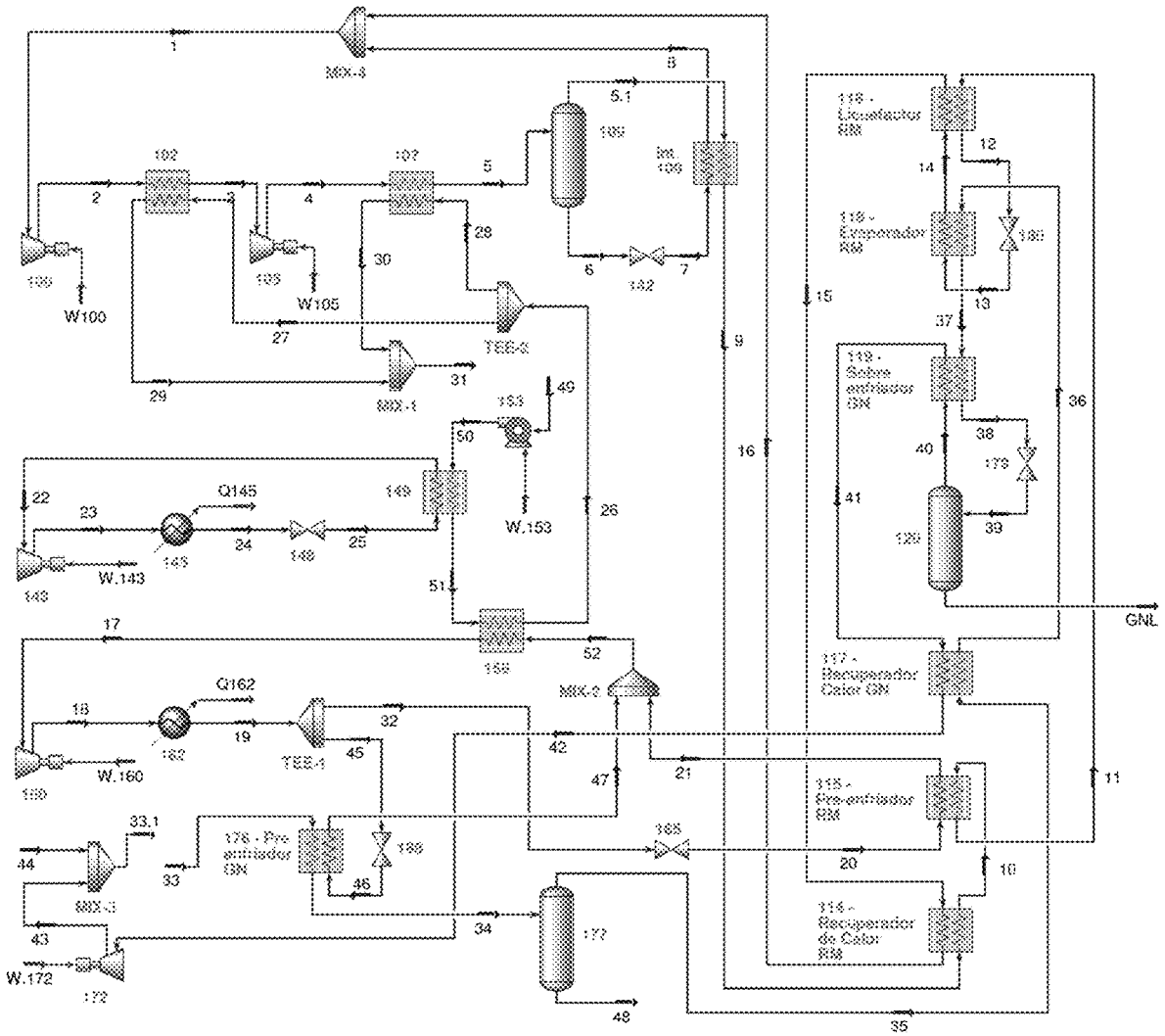
FIG. 3 shows a view of the thermodynamic scheme used for the simulation, without considering those accessories that do not affect the process, for example, manoeuvre valves, oil separators, filters, sight glasses, etc., and finally.

FIG. 3 shows the thermodynamic scheme used for a simulation, corresponding to the preferred embodiment of FIG. 1, without considering those accessories that do not affect the process, for example, manoeuvre valves, oil separators, filters, sight glasses, or the mixed refrigerant buffer tank and its accessories. Aspen Hysys V10 software has been used for the simulation. The same designations have been used for the mass streams of the different refrigerants as in FIG. 1. Simplifications have also been made in the loop to represent the functionality of the water/glycol cooling coil, replacing it with an exchanger, therefore there are streams 49, 50 and 51 not illustrated in FIG. 1. On the other hand, the liquid separator and mixed refrigerant coalescing filter have been represented as two associated devices. The water streams and the natural gas loop have also been cut off to carry out the simulation until convergence is achieved with a set of temperatures that do not cause cross-temperatures in the heat exchangers.

Figure 4:
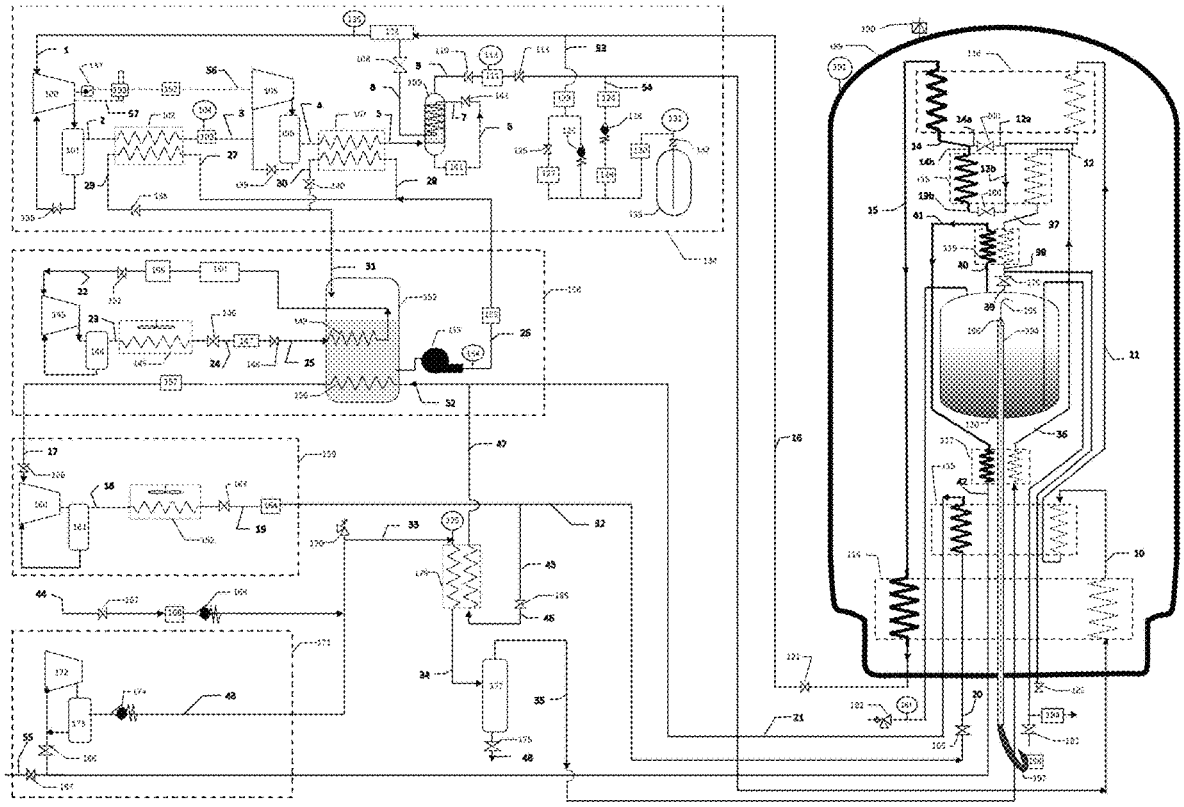
FIG. 4 shows a view of the alternative thermodynamic scheme of the mini gas liquefaction plant according to the present invention.

FIG. 4 shows a view of the alternative thermodynamic scheme of the mini gas liquefaction plant according to the present invention. In this case there is great similarity throughout the scheme, with the exception that the mixed refrigerant flow 12 after condensing at 116 is divided into two, 12*a* and 12*b* and there are two throttles, at 200 and 180 respectively such that a bypass is made through capillary 200 that diverts part of the refrigerant mass without passing through the mixed refrigerant evaporator 118, thereby reducing the pressure loss within it and favoring the performance of the exchanger. Then flows 14*a* and 14*b* join to form stream 14 that enters entirely the liquefier 116. The entire system subsequently remains the same. It must be kept in mind that the pressure drop in evaporator 118 must be as small as possible, otherwise this could cause the temperatures at 14 to be lower than those at 13*b*.

Example

The simulation of the proposed thermodynamic cycle was carried out with the Aspen Hysys V10 program with the following results:

In a stable condition, a production of 30.98 Kg/h was achieved, which would be equivalent to 1754 L/day with an LNG density of 422.8 Kg/m$^3$ at a temperature of −149.2° C. and a pressure of 45 psia.

The electrical power required by the equipment would be 23.65 KW, which gives us a specific electrical consumption of 0.763 Kw h/Kg of LNG, which is equivalent to 31.79 Kw day/ton LNG, which is a high value if we compare it with the unit consumption of large plants, but is similar to the consumption of small plants and is lower than the consumption of the Stirling LNG system.

FIG. 5 presents a table with all the values of the mass and energy streams of the simulation carried out that correspond to the preferred embodiment of FIG. 1. The composition of the natural gas adopted corresponds to stream 44 and has also been adopted same composition in stream 33, neglecting the composition variation that could occur due to the effect of the nitrogen contained in the Natural Gas and that could be vented in each LNG discharge. The composition of the Mixed Refrigerant adopted corresponds to stream 1.

The invention claimed is:

1. A gas liquefaction process for a natural gas pre-treated for liquefaction, the process comprising the steps of:

conveying said pre-treated gas at a pressure between 150 and 200 psia, and a temperature between 15 and 20° C., to a first pre-cooling heat exchanger, wherein the pre-treated gas is cooled by exchanging heat in counter-stream with a cycle of propane, thus being refrigerated to a temperature between −10 and −15° C., directing the gas from the previous step to a higher hydrocarbon separator to separate a fraction of liquefied gas at the bottom, when there are condensable traces and the dry gas is released at the top, conveying the gas separated from said upper part of the previous step to a cool box, to circulate it through a second recuperative type counter-stream heat exchanger, thus producing cooling to a range of −15 to −20° C., conveying the natural gas from the previous step to a third counter-stream heat exchanger, producing additional counter-stream cooling with a mixed refrigerant loop, until partial liquefaction of said gas is achieved at a temperature between −130 and −140° C., conveying the gas from the previous step partially or completely liquefied to a fourth recuperative heat exchanger, increasing the gas percentage of liquefaction or sub-cooling, within a temperature gradient of 0.5 to 1° C., as heat is exchanged in counter-stream with the gas itself at low pressure, passing the flow of liquid natural gas thus achieved through a throttle valve, producing its expansion in a cryogenic collector tank, wherein its pressure decreases to a range between 45 and 50 psia, and reaches a temperature of −148 to −150° C., producing partial vaporization, collecting and storing the liquid fraction in said cryogenic collector tank, and conveying the vapors from the previous step to the fourth recuperative heat exchanger and then to the second natural gas exchanger to achieve recuperative cooling, extracting the liquefied natural gas from the cryogenic collector tank, and compressing said portion of partially vaporized gas that produced the recuperative cooling in a compressor, to be injected together with the pre-treated natural gas from the first stage, thus re-starting the process.

2. The process of claim 1, further comprising the step of carrying out the extraction of liquefied natural gas from the cryogenic collector tank manually through a valve.

3. The process of claim 1, further comprising the step of carrying out the extraction of liquefied natural gas from the cryogenic collector tank intermittently by a solenoid valve automatically by weighing the gas contained in the tank, or by a level sensor installed in the tank.

4. The process of claim 1, further including a second mixed refrigerant loop that has two compressors associated in series (or a two-stage compressor) for said mixed refrigerant, counting the compression process with intermediate refrigeration and in high pressure, through a first and second mixed refrigerant heat exchanger.

5. The process of claim 4, wherein the mixed refrigerant is composed of selected natural refrigerants including at least nitrogen, methane, ethylene, propane and butane.

6. The process of claim 1, further including a third refrigerant loop for the pre-cooling stage of the natural gas and the mixed refrigerant that is carried out with propane (R290).

7. The process of claim 4, wherein said first and second mixed refrigerant heat exchangers are cooled by a water/glycol auxiliary refrigerant.

8. The process of claim 7, wherein the water/glycol auxiliary refrigerant is cooled by a fourth R22 refrigerant system.

9. A gas liquefaction plant for natural gas comprising:

a) a first loop of pre-treated natural gas that is supplied at a pressure of 150 to 200 psia and is led to a first heat exchanger that pre-cools the natural gas with a propane cycle, then the gas is led to a separator of phases that retains the condensable traces if there are higher hydrocarbons and the gas fraction is directed to a cool box that has a liquefaction column made up of a second recuperative type counter-stream heat exchanger, a third counter-stream heat exchanger that exchanges heat with a mixed refrigerant loop and a fourth recuperative heat exchanger, connected in series in that order, said fourth heat exchanger being connected through a throttle valve with the inlet of a cryogenic collector tank that accumulates the gas fraction liquefied natural gas, and the gas fraction is vented from the tank to produce recuperative cooling, passing through the forth and then the second exchanger respectively at low pressure, to finally be re-injected by a compressor along with the pre-treated gas stream, b) a second mixed refrigerant loop that has a low pressure compressor for the mixed refrigerant, the same being connected, through an oil separator and a first mixed refrigerant heat exchanger, with a high pressure compressor for the mixed refrigerant having an outlet connected to an oil separator in series with a second mixed refrigerant heat exchanger or a two-stage compressor with intermediate cooling and a high pressure oil separator extending from said second exchanger of heat to a coalescing filter that leads the mixed refrigerant to a third recuperative type heat exchanger that we call mixed refrigerant heat recovery which has an outlet that leads the mixed refrigerant to a fourth exchanger that acts as a pre-cooler for the mixed refrigerant with an auxiliary propane cycle, which leads to a fifth recuperative exchanger that acts as a liquefier for the mixed refrigerant, extending from its outlet a condensate line that passes through a throttle valve that allows the expansion of the mixed refrigerant in an heat exchanger or mixed refrigerant evaporator through which the natural gas passes in counter-stream, wherein the mixed refrigerant then passes at low pressure through the mixed refrigerant liquefier and subsequently through the mixed refrigerant heat recovery, producing recuperative refrigeration in both and from there it returns to the low-pressure compressor, said mixed refrigerant heat recovery being said mixed refrigerant pre-cooler, said mixed refrigerant liquefier and mixed refrigerant evaporator arranged within said cool box, c) a third pre-cooling loop with propane that comprises a single-stage compressor that draws in the refrigerant at low pressure and drives it to an oil separator connected to a condenser cooled by forced air and from there a streamline emerges in liquid state that is divided into two, one of them goes to the natural gas pre-cooler to which it enters through a thermostatic valve that allows its expansion therein and the second line goes to another thermostatic valve that expands the refrigerant in the mixed refrigerant pre-cooler, wherein the low-pressure propane outlets of both exchangers are unified again and absorb residual heat from an auxiliary water-glycol refrigerant, over-heating before being drawn in again by the compressor, and d) a fourth loop with R22 Refrigerant or another similar one intended to cool the mixed refrigerant after each compression stage through a water/glycol auxiliary fluid, wherein the loop comprises a compressor that receives the R22 refrigerant vapors at low pressure and discharges them compressed into an oil separator associated in series with a condenser cooled by forced air, whose outlet leads to a thermostatic expansion valve that expands in refrigerant in an evaporator and subsequently the R22 refrigerant is drawn in again by the compressor, wherein the evaporator cools the water/glycol auxiliary fluid and maintains it between 5 and 9° C., which is pumped from a tank and is diverted into two for the first and second mixed refrigerant heat exchangers, which are in parallel and return the auxiliary fluid later to the tank.

10. The liquefaction plant of claim 9, characterized in that in the natural gas loop said first natural gas cooler exchanger comprises a plate counter-stream heat exchanger that is cooled by a propane cycle to a temperature of −10/−15° C.

11. The gas liquefaction plant of claim 9, wherein in the natural gas loop the upper hydrocarbon separator comprises a tank with a tangential gas inlet in the lower third thereof that separates the liquid fractions, and internally has a grate over said inlet that acts as a support for a filling material with a high specific surface area that favors condensation, selected from tiles, stainless filling or another similar, and the gases exit from the upper part and condensed liquid from the lower part.

12. The gas liquefaction plant of claim 9, wherein in the natural gas loop said first exchanger with propane cools the natural gas to −10/−15° C., said second heat exchanger is of the counter-stream recuperative type and cools it to −15/−30° C., the third counter-stream heat exchanger is the mixed refrigerant evaporator that cools and liquefies the natural gas at a temperature of −130/−140° C., and said fourth heat exchanger recovery is a natural gas over-cooler, which over-cools it between 0.5 to 1° C.

13. The gas liquefaction plant of claim 9, wherein in the natural gas loop said throttle valve is a Joule-Thomsom valve including a capillary tube.

14. The gas liquefaction plant of claim 9, wherein said cryogenic collector tank contains the liquefied gas at an internal temperature of −148/−150° C., and has a natural gas vapor outlet connected to said fourth recuperative heat exchanger, which in turn has an outlet connected to said second recuperative heat exchanger, said collector tank also having at least one liquefied natural gas (LNG) extraction valve.

15. The gas liquefaction plant of claim 14, wherein said cryogenic collector tank has an over-flow tube that exits from the cool box and ends in a closed copper coil at the end so that when the liquid reaches the height of the opening of the over-flow conduit it flows to the lower end wherein a temperature sensor is installed that will cause the entire unit to stop, said over-flow tube is presented inside another tube that ends at the top of the tank in a curved shape downward and goes to the bottom of the over-flow tube to equalize the pressures and avoid obstructions due to the formation of pressurized bubbles in it and at the junction of both tubes there is an inverted cone held by the central tube that prevents the entry of LNG condensed from the smaller diameter tube.

16. The gas liquefaction plant of claim 9, wherein in the mixed refrigerant loop said low pressure compressor has a mixed refrigerant stream discharge at a pressure of 120/140 psia and is connected to an oil separator for refrigeration with a float preferably of the helical type from which a return to the oil compressor is provided and the refrigerant passes to said first mixed refrigerant heat exchanger which is cooled by water/glycol wherein the temperature of the mixed refrigerant is reduced, and then passes to the second high pressure compressor that raises the pressure of the refrigerant to a value of 275/300 psia, and is connected to an oil separator similar to the previous one that returns the oil to the compressor and the refrigerant passes to a second heat exchanger that is cooled by water/glycol, and which has an outlet connected to a coalescing filter and cyclone separator.

17. The gas liquefaction plant of claim 16, wherein the coalescing filter and separator retains the condensable fractions of the refrigerant and traces of oil and throttles said stream by a capillary that expands said fraction in a tube wound inside the separator, which reduces the temperature of the main refrigerant stream, absorbing heat from it, the low-pressure stream returns to the inlet of the low pressure compressor and the main high pressure stream is directed to the cool box.

18. The gas liquefaction plant of claim 9, wherein said mixed refrigerant pre-cooler is a heat exchanger that constitutes the evaporator of a cycle that uses propane (R290) as a refrigerant that circulates in counter-stream.

19. The gas liquefaction plant of claim 9, wherein in the R22 cycle said condenser is an atmospheric condenser with forced air cooling and said evaporator is sub-merged in a water/glycol reservoir in which it absorbs heat and cools the mentioned liquid, wherein the evaporator is includes a plate, shell, or tube heat exchanger.

20. The gas liquefaction plant of claim 9, wherein said mixed refrigerant heat recovery, said mixed refrigerant pre-cooler, said mixed refrigerant liquefier, said mixed refrigerant evaporator, the recuperative type counter-stream heat exchangers of the natural gas and said cryogenic collector tank are thermally insulated within said cool box.

21. The gas liquefaction plant of claim 9, wherein the heat exchangers arranged in the cool box have descending flows when they are in the condensation process and ascending flows when are in the evaporation process and the high pressures are conducted through the internal tubes and the low pressures by the external ones in the respective helical exchangers.

22. The gas liquefaction plant of claim 9, wherein the mixed refrigerant loop has a buffer tank and solenoid valves that allow modifying the effective mass that operates in the refrigeration cycle during the cooling process in order to avoid over-pressures during the start-up process, wherein said buffer tank is connected to the high-and low-pressure system of the system through solenoid valves activated by an electronic monitoring system of these pressures that allows regulating the inlet or outlet of refrigerant mass to the tank in order to maintain approximately constant pressures at all times and optimize stable operation, wherein the supply of mixed gas to the low-pressure compression system from the tank is carried out through a capillary associated in series with the low-pressure solenoid valve in order to controllably enter the refrigerant mass into the system.

23. The gas liquefaction plant of claim 9, wherein an alternative modification in the mixed refrigerant cycle, which proposes the expansion of the high-pressure mixed refrigerant when leaving the liquefier by means of two throttling processes with suitable capillaries that divert the flow into two, one of them to allow its expansion in the mixed refrigerant evaporator and the other joins the outlet of said evaporator, acting as a by-pass, joining both flows to enter the liquefier at low pressure, all other processes remaining the same, wherein the pressure loss in the mixed refrigerant evaporator is reduced.

* * * * *